US005186676A

United States Patent [19]

Morton

[11] Patent Number: 5,186,676

[45] Date of Patent: Feb. 16, 1993

[54] MODEL RACING CAR TIRE AND WHEEL ASSEMBLY

[75] Inventor: Timothy L. Morton, Troy, N.C.

[73] Assignee: Total Racing Connection, Inc., Albemarle, N.C.

[21] Appl. No.: 686,789

[22] Filed: Apr. 17, 1991

[51] Int. Cl.[5] ..... A63H 17/26; B60C 7/00

[52] U.S. Cl. ..... 446/465; 152/323; 301/64.7

[58] Field of Search ..... 446/465; 301/63 PW; 152/313, 323, 324, 325

[56] References Cited

U.S. PATENT DOCUMENTS

| | | | |
|---|---|---|---|
| 1,952,708 | 3/1934 | Gruenberg | 446/465 |
| 2,709,471 | 5/1955 | Smith et al. | 152/323 X |
| 3,179,148 | 4/1965 | Chapman | 152/323 X |
| 3,224,483 | 12/1965 | Gross et al. | 152/187 |
| 3,348,597 | 10/1967 | Goldberg et al. | 152/323 |
| 3,387,894 | 6/1968 | Louik | 301/63 |
| 3,408,770 | 11/1968 | Smolinski et al. | 446/465 |
| 3,730,594 | 5/1973 | Zbikowski | 301/63 PW |
| 3,952,786 | 4/1976 | Kreling et al. | 152/323 |
| 4,278,297 | 7/1981 | Suzuki et al. | 301/6 D |
| 4,940,445 | 7/1990 | DesPortes | 446/465 |

FOREIGN PATENT DOCUMENTS

| | | | |
|---|---|---|---|
| 14915 | of 1899 | United Kingdom | 152/323 |
| 1315160 | 4/1973 | United Kingdom | 301/63 PW |

OTHER PUBLICATIONS

Total Racing Connection Catalog, 1991, Albemarle, N.C. 28001.

*Primary Examiner*—Mickey Yu

*Attorney, Agent, or Firm*—Bell, Seltzer, Park & Gibson

[57] ABSTRACT

A body of foam rubber overlies a generally cylindrical rim of the wheel of the assembly. A tread rubber body has a central section that overlies the outer surface of the tread rubber body. Side sections of the tread rubber body extend angularly from its central section and overlie opposite sides of the foam rubber body. The foam rubber body is bonded to the rim of the wheel assembly. A central section of the tread rubber body is boned to the outer surface of the foam rubber body. Opposite side sections of the tread rubber body are bonded to opposite sides of the foam rubber body, and may also be bonded to opposite edge portions of the wheel rim. The side sections of the tread rubber body reduce the possibility of foam rubber being ejected from the sides of the foam rubber body, and also reduce outward expansion of the bodies due to centrifugal force.

24 Claims, 1 Drawing Sheet

MODEL RACING CAR TIRE AND WHEEL ASSEMBLY

FIELD OF THE INVENTION

This invention relates to tire and wheel assemblies for model racing cars, and particularly for tenth-scale or similar model racing cars that are radio-controlled and that attain high speeds.

BACKGROUND OF THE INVENTION

Each tire/wheel assembly of a model race car of the foregoing type customarily includes a substantially rigid wheel having a cylindrical rim. A foam rubber body encircles and is bonded to the outer cylindrical surface of the rim. A body of more dense tread rubber overlies and is bonded to the radially outer cylindrical surface of the foam rubber body. The foam rubber body of each tire/wheel assembly is subjected to severe stress during operation of the race car. When the car collides at high speeds with another car or a wall of the race track, the force of the impact can and frequently does cause chunks of the foam rubber material to be torn from one or both of the exposed opposite sides of the foam rubber body. Additionally, as the speeds attained by the cars increase, the "ballooning" type of radial displacement undergone by the rubber bodies, due to centrifugal force, is more likely to cause the foam rubber body to undergo internal separation and/or separation from the tread rubber body or the rim of the assembly. The foregoing undesirable occurrences shorten the useful life of the wheel assemblies and impair the performance of the cars.

SUMMARY OF THE INVENTION

The present invention provides an improved tire and wheel assembly, particularly for model race cars of the above-noted type, that minimizes damage to the foam rubber body due to impacts and/or centrifugal forces. In addition to having a central section that overlies the foam rubber body, the tread rubber body of the improved wheel assembly has opposite side sections that extend angularly from the central section and overlie and shield opposite side surfaces of the foam rubber body. The side sections of the tread rubber body prevent or at least minimize impact-induced ejection of chunks of the foam rubber body from one of its opposite sides. The side sections also decrease the tendency of the tread rubber body, and thus of the underlying foam rubber body, to undergo excessive radial "ballooning" due to centrifugal force.

In a preferred embodiment of the assembly, the opposite side sections of the tread rubber body cover substantially all of the opposite side surfaces of the foam rubber body adjacent thereto, and are bonded to such surfaces. Terminal edges of the side sections of the tread rubber body preferably engage, and may also be bonded to, the radially outer cylindrical surface of the rim of the wheel assembly. Outer side surfaces of the side sections of the tread rubber body preferably lie in radially extending planes containing the opposite sides of the wheel rim.

DESCRIPTION OF THE PRIOR ART

Model racing car tire and wheel assemblies having a foam rubber body disposed between the wheel rim and a body of more dense rubber are disclosed in U.S. Pat. Nos. 3,408,770 and 4,940,445.

BRIEF DESCRIPTION OF THE DRAWINGS

Other features of the invention will be apparent from the following description of an illustrative embodiment thereof, which should be read in conjunction with the accompanying drawings, in which.

DESCRIPTION OF THE PREFERRED EMBODIMENT

Figure 1:
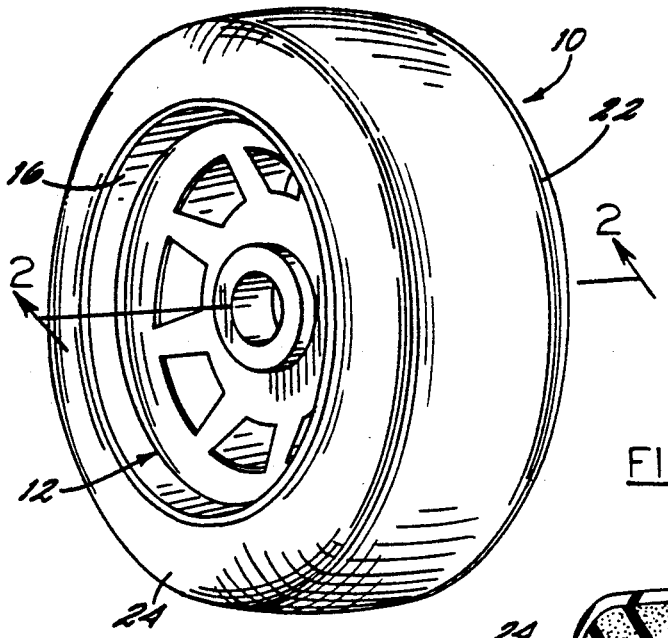
FIG. 1 is a side perspective view of a wheel assembly in accordance with the invention.
Figure 2:
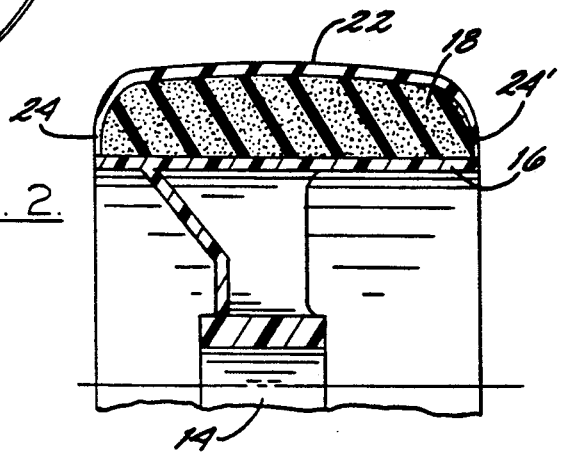
FIG. 2 is a fragmentary sectional view taken generally along the lines and in the direction of the arrows 2—2 through the wheel assembly of FIG. 1.
Figure 3:
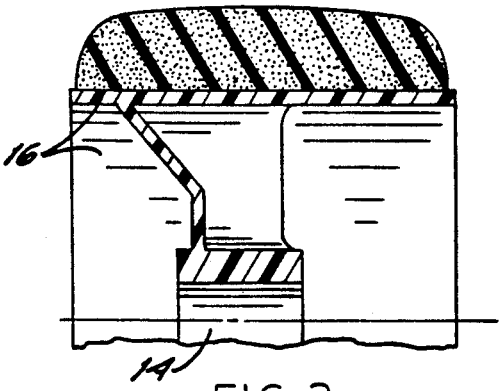
FIG. 3 is a fragmentary sectional view similar to FIG. 2, but lacking the tread rubber body.
Figure 4:
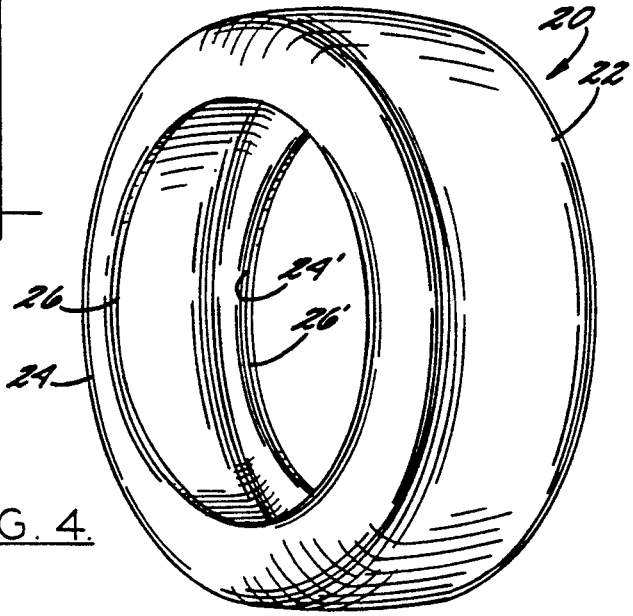
FIG. 4 is a side perspective view of the tread rubber body of the assembly.

The wheel and tire assembly 10 shown in FIG. 1 of the drawings is particularly adapted for use on a radio-controlled, high-speed, tenth-scale or similar model race car. Assembly 10 includes a wheel 12 having interconnected concentric annular hub and rim members 14, 16. Wheel 12 may be formed of any suitable rigid or semi-rigid material, and customarily is molded from durable thermoplastic material. As is well known to those skilled in the art, hub 14 is adapted to receive an axle (not shown) of a model race car (not shown). A tire upon wheel 12 includes an annular body 18 of foam rubber, which preferably is a Styrene/Butadiene based rubber. Body 18 encircles, engages and preferably is bonded to the cylindrical outermost surface of wheel rim 16. Rubatex Corp. of Bedford, Va., sells foam rubber of a type suitable for manufacture of body 18, and also sells, under its number 27330, an adhesive suitable for bonding the inner surface of the body to the cylindrical outer surface of rim 16. As is indicated in FIG. 3 of the drawings, the opposite sides of foam rubber body 18 preferably are spaced inwardly from thereto adjacent ones of the opposite side edges of wheel rim 16. If the model racing car (not shown) with which assemblies 10 are associated is to run on a banked oval or circular race track, the foam rubber body 18 of each assembly may and normally would have a different cross-sectional profile or contour depending upon whether it is located upon the front or the rear of the car and whether it is adjacent the inside or the outside of the race track.

The tire of each assembly 10 further includes a body 20 of more dense and durable "tread" rubber. Uncured tread rubber suitable for molding of the body is sold by M & H Tire Co. of Gardner, Mass. under the numbers 400 (Hard), 310 (Medium), and 24 (Soft). The tread rubber is preferably cured at a temperature of 330°-350° F. for 6-13 minutes. Each molded and cured tread rubber body 20 preferably and illustratively is of endless annular shape, and is resiliently extensible and contractible. A central section 22 of each body 20 extends in overlying encircling engagement with the radially outer surface of body 18. Each body 20 further includes opposite side sections 24, 24' that are integral with and extend angularly inwardly from opposite sides of central section 22 toward wheel rim 16. Each side section 24, 24' of body 20 preferably and illustratively overlies and engages substantially all of the thereto adjacent one of the opposite sides of foam rubber body 18, and has a terminal edge 26 or 26' that is adjacent to, and preferably and illustratively is in engagement with, an edge portion of the outer cylindrical surface of wheel rim 16. Along at least part of its length, the outer surface of each side section 24, 24' preferably is substantially "flush" or coplanar with the thereto adjacent side surface of rim 16. Each side section 24, 24' preferably is bonded to the confronting one of the opposite sides of foam rubber body 18 and to the confronting edge portion of rim 16. A preferred styrene based adhesive for bonding tread rubber body 20 to foam rubber body 18 is sold by Eclectic Products, Inc., of San Pedro, Calif., under the designation ECLECTIC 6000. The adhesive is placed on the tread rubber body 20 and allowed to dry for three to four hours. It is then reactivated with a thinned solution of the adhesive and mounted on foam rubber body 18 after the latter has also been coated with the thinned adhesive. After the adhesive has been allowed to cure for approximately twelve hours, the bonded assembly is placed in a drying oven for ninety minutes at 110° F. to eliminate moisture that may be in the adhesive.

The thickness of tread rubber body 20 typically is approximately 0.065 inches throughout most of the width of central section 22, is approximately 0.030 inches in most of each side section 24, 24', and has an intermediate tapering thickness between the central section and each side section.

The diameter of the inwardly facing cylindrical surface of central section 22 of rubber body 20 is approximately 2.100 inches when such body is in an unstretched condition. This is less than the outer diameter of foam rubber body 18, which typically is within the range of 2.350–2.390 inches. Tread rubber body 20 therefore is stretched when mounted in association with the other components of assembly 10. The stretched condition of body 20 assists in minimizing radial displacement of body 20 under the impetus of centrifugal force. In addition to preventing or at least minimizing escape of foam rubber from opposite sides of foam rubber body 18, opposite side sections 24, 24' of tread rubber body 20 also assist in minimizing outward displacement of the rubber components of assembly The opposite side sections 24, 24' of tread rubber body 20 also cause more of the mass of the body to be located adjacent the outer sides of each wheel assembly 10. This increases the "fly wheel" effect of the rotating assembly, which in turn facilitates maintenance of the speed of the model racing car as it travels about curves or corners of the race track. The opposite side sections of the tread rubber body also reduce lateral flexure of assembly 10, which makes it easier to control the path of travel of the model racing car.

Although the illustrated and described assembly has a relatively smooth outer surface suitable for "track" racing, the invention also is applicable to a model race car wheel assembly of the "spiked" off-the-road type. It should therefore be understood that while a specific embodiment of the invention has been shown and described, this was for purposes of illustration only, and not for purposes of limitation, the scope of the invention being in accordance with the following claims.

I claim:

1. A tire and wheel assembly for a high-speed, radio-controlled model racing car, comprising:

a wheel having a generally cylindrical rim;

a foam rubber body overlying said rim and having opposite side surface adjacent respective ones of the opposite sides of said rim;

a tread rubber body having a central section overlying said foam rubber body, and having opposite side sections extending angularly from said central section and located adjacent respective ones of said opposite side surfaces of said foam rubber body.

2. An assembly as in claim 1, wherein said foam rubber body encircles and is bonded to said rim.

3. An assembly as in claim 1, wherein said central section of said tread rubber body encircles and is bonded to said foam rubber body.

4. An assembly as in claim 1, wherein said side sections of said tread rubber body engage respective adjacent ones of said side surfaces of said foam rubber body.

5. An assembly as in claim 4, wherein said side sections of said tread rubber body are bonded to respective adjacent ones of said opposite side surfaces of said foam rubber body.

6. An assembly as in claim 5, wherein said side sections of said tread rubber body cover substantially all of said opposite side surfaces of said foam rubber body.

7. An assembly as in claim 1, wherein each of said opposite side sections of said tread rubber body has an outer surface that is substantially coplanar with a radially extending plane containing an edge surface of said rim.

8. An assembly as in claim 1, wherein each of said opposite side sections of said tread rubber body has a terminal edge in closely adjacent relationship to said rim.

9. An assembly as in claim 8, wherein said terminal edge of each of said side sections of said tread rubber body engages said rim.

10. An assembly as in claim 8, wherein said terminal edges of said side sections of said tread rubber body engage a cylindrical surface of said rim.

11. An assembly as in claim 8, wherein said terminal edges of said side sections of said tread rubber body are bonded to said rim.

12. An assembly as in claim 1, wherein said foam rubber body is of continuous annular shape, and is formed of a Styrene/Butadiene based rubber and has a contoured non-cylindrical outer surface.

13. An assembly as in claim 1, wherein said tread rubber body has an endless annular shape, is elastically extensible and contractible, and said central section thereof has in its relaxed condition a diameter less than the outer diameter of said foam rubber body.

14. An assembly as in claim 13, wherein said central section of said tread rubber body has a greater thickness than said side sections of said body.

15. A tire and wheel assembly for a high-speed, radio-controlled model race car, comprising:

a wheel having a generally cylindrical rim;

a foam rubber body overlying, encircling and bonded to the radially outermost surface of said rim, said foam rubber body having an outer surface spaced radially from said rim, and having opposite side surfaces adjacent respective ones of the opposite sides of said rim;

an endless annular extensible and contractible tread rubber body having a central section overlying and encircling and bonded to- said outer surface of said foam rubber body, and having opposite side sections extending angularly from said central section and overlying respective ones of said opposite side surfaces of said foam rubber body.

16. An assembly as in claim 15, wherein said opposite side sections of said tread rubber body cover substantially all of said opposite side surfaces of said foam rubber body.

17. An assembly as in claim 15, wherein said opposite side sections of said tread rubber body are bonded to respective ones of said opposite side surfaces of said foam rubber body.

18. An assembly as in claim 15, wherein said side sections of said tread rubber body have terminal edges extending in encircling and generally parallel relationship to said radially outermost surface of said rim.

19. An assembly as in claim 18, wherein said terminal edges of said outer sections of said tread rubber body engage said radially outermost surface of said rim.

20. An assembly as in claim 19, wherein said terminal edges of said outer sections of said tread rubber body are bonded to said radially outermost surface of said rim.

21. A tire and wheel assembly for a high-speed, radio-controlled model racing car, comprising:

a wheel having a generally cylindrical rim;

a foam rubber body encircling said rim, said foam rubber body having radially spaced inner and outer surfaces and having laterally spaced opposite side surfaces;

a tread rubber body encircling said foam rubber body, said tread rubber body having a central section overlying said outer surface of said foam rubber body, and having at least one side section overlying a thereto adjacent one of said side surfaces of said foam rubber body.

22. A tire and wheel assembly as in claim 21, wherein said foam rubber body is bonded to said rim.

23. A tire and wheel assembly as in claim 21, wherein said tread rubber body is bonded to said foam rubber body.

24. A tire and wheel assembly as in claim 21, wherein said tread rubber body is bonded to said wheel.

* * * * *